US006973674B2

(12) United States Patent
Jackson, Jr.

(10) Patent No.: US 6,973,674 B2
(45) Date of Patent: Dec. 13, 2005

(54) COMBINATION OF AN IMPROVED GOLF GLOVE WITH A GOLF TEE

(76) Inventor: William E Jackson, Jr., 765 SW. 148 Ave., #1212, Davie, FL (US) 33325

( * ) Notice: Subject to any disclaimer, the term of this patent is extended or adjusted under 35 U.S.C. 154(b) by 0 days.

(21) Appl. No.: 10/752,242

(22) Filed: Jan. 6, 2004

(65) Prior Publication Data

US 2005/0144699 A1 Jul. 7, 2005

(51) Int. Cl.[7] ..... A41D 19/00
(52) U.S. Cl. ..... 2/161.2; 2/161.1
(58) Field of Search ..... 2/16, 20, 159, 2/160, 161.1, 161.2, 161.4, 162, 163; 473/205

(56) References Cited

U.S. PATENT DOCUMENTS 5,365,609 A * 11/1994 Herzog ..... 2/161.4
6,205,588 B1 * 3/2001 Shin ..... 2/161.4
2003/0014806 A1 * 1/2003 Canion ..... 2/161.4

* cited by examiner

*Primary Examiner*—Gary L. Welch

(57) ABSTRACT

A golf glove having a palm covering portion and a back of the hand covering portion and a seam means securing the portions together along a side of the glove which, in use, confronts the side of the hand of a wearer between the wrist and proximal end of the little finger reinforcing the margins of the portions along the seam, and socket defining loops of elastic ribbon secured to the side sized to yield within its elastic limit to receive the shaft of a golf ball in the loops to temporarily store and snugly hold it and orient the tee shaft into a position closely adjacent and in alignment with the metacarpol bone of a wearer of the glove between the wrist and proximal end of the little finger.

3 Claims, 1 Drawing Sheet

COMBINATION OF AN IMPROVED GOLF GLOVE WITH A GOLF TEE

FIELD OF THE INVENTION

This invention relates to an improved golf glove, which includes a golf tee storage socket. It is for use while playing golf while a stored golf tee is in the storage socket and remains in an out of the way position.

BACKGROUND OF THE INVENTION

It is well known that a golfer often wishes to have a golf tee handy for use. Many golfers keep a golf tee in their shoe. Others keep a spare tee in one of various other places on their person. Some golfers even keep a spare tee tucked behind an ear, or in their belt or even in their hair. In recognition of this need, patents have been granted in the past addressing this need. An example of prior art is found in the disclosure in U.S. Pat. No. 5,365,609, which provides a golf tee storage device on the portion of the glove that, in use and while being worn, overlays the back of the hand of the golfer. This prior art golf tee holding means is attached to that portion of the golf glove which overlays the back of the golfer's hand; however, the tee extends laterally across the back of the hand of a wearer. When playing golf, during the actual swing of the club, in particular, a wide range of actual movement takes place of the golfer's hand and about the golfer's wrist; and the device of that prior art patent is apt to cause the stored tee to interfere with the golfer's movements while actually playing golf as well as while not actually gripping and swinging the a golf club or putter.

This invention overcomes the foregoing problem of interference of a stored golf tee and a golfer's hand movements, whether real or perceived, yet accommodates convenient storage and transport of a spare tee which is at all times conveniently at hand for use whenever desired.

SUMMARY OF THE INVENTION

Objects of the Invention

It is a general object of the invention to provide an improved golf glove which includes socket defining means sized and located on the glove in a specific location, namely, along the portion of the glove that overlays the little finger side of the hand of a wearer between the wrist bones, o or carpols and the proximal end of the little finger, and along the metacarpol.

It is also an object to provide such a device of the type described which is of inexpensive to manufacture, is simple in construction, and, as is illustrated in the attached drawings and this description, is well adapted for its use and its intended purposes.

DESCRIPTION OF THE DRAWINGS

Referring to the drawings.

DESCRIPTION OF THE PREFERRED EMBODIMENT OF THE COMBINATION OF THE GLOVE AND A GOLF TEE

To completely illustrate the merit of the invention, a moving picture would be helpful to show the different attitudes of the human hand and the range of different shapes it assumes and different contours its surface forms when moving through a range off movements typical of a golfer's hand while playing golf. However, in spite of this virtual infinity of shapes, the length of the side of the hand between the wrist of a wearer of a golf glove and the proximal end of the little finger is generally constant and, moreover, remains in a straight line, irrespective of movements through elevation angles, through azimuth angles, and the variations of the tightness of the golfer's grip. This invention provides a storage means for a golf tee on this length.

Figure 1:
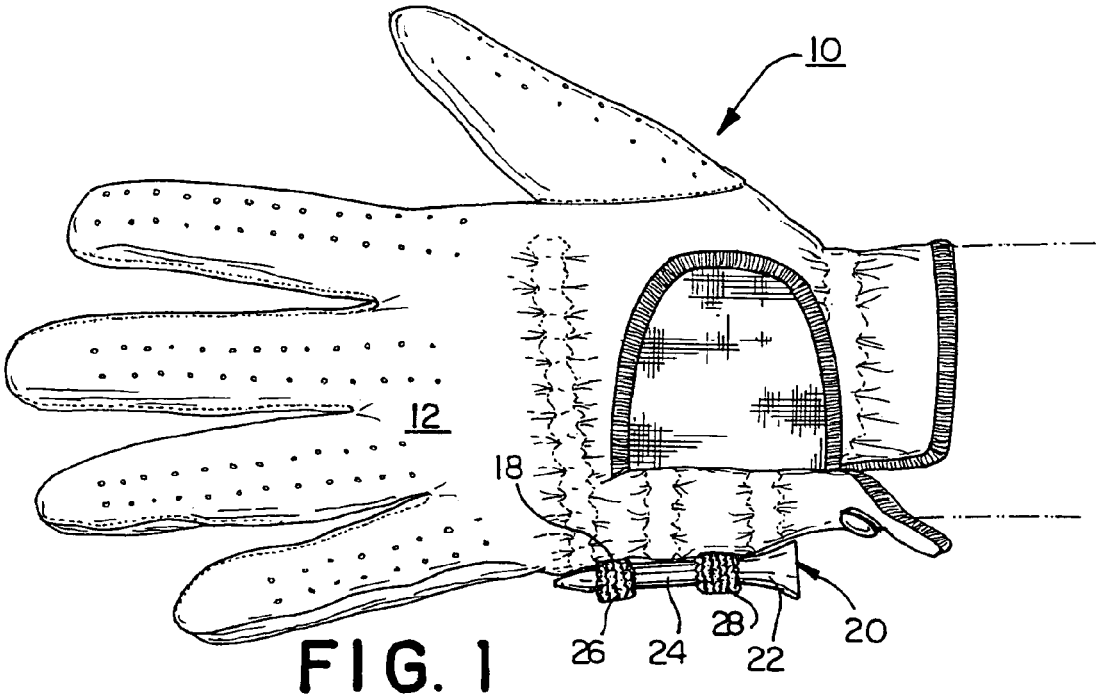
FIG. 1 illustrates a back of the hand view of a glove according to the invention in combination with a golf tee and while worn by a wearer.
Figure 2:
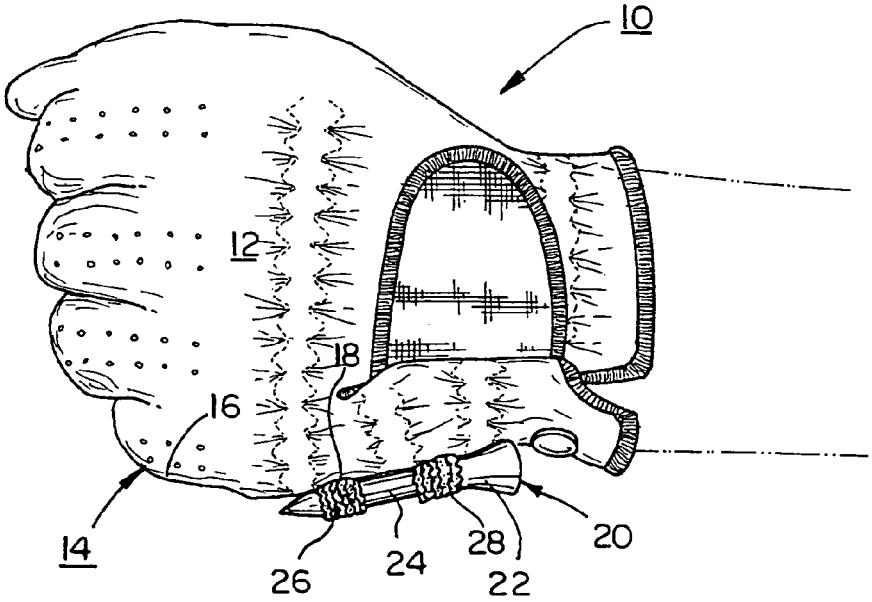
FIG. 2 illustrates the invention on the hand of a wearer in one attitude.

As seen in FIGS. 1 and 2, the glove 10 is a conventional golfer's glove in most respects. Accordingly, it has a "back of the hand" portion 12 and a "front of the hand" portion, or "palm" portion, 14, as well as a "little finger side" portion 16, see FIG. 2, which ordinarily has a longitudinally extending central zone which usually includes a seam 18 connecting the main glove portions. This seam 18 serves as a relatively reinforced location. The glove is of pliable thin sheet material, somewhat stretchable, or rubbery, so as to conform to the contours of the hand of a user while ever changing while golf is being played. Some such gloves are made of plastic laytex material; others are made of leather. In any event the fit of the golf glove is snug, in a sense constituting a virtual outer skin. The little finger side portion and the seam, usually located there, overlays the wrist bone, or carpal, the little finger metacarpal bone, and the little finger phalange. It will be noted at this juncture that the length along the side surface, or seam length, between the wrist bone and the little finger phlange along the metacarpal is somewhat greater than the length of a conventional golf tee; and, importantly, that this zone remains relatively straight and unchanging in contrast to the other surfaces of the glove portions which change in contour during use and do not always remain straight.

The golf tee storage means 20 is provided on the length, or seam, defining a golf tee socket defining means to snugly and circumferentially hold a golf tee 22 along its shaft 24 without interfering with the wrist action of the glove wearer while golfing. The socket defining means illustrated is a pair of spaced elastic loops 26, 28 each of which is attached to the glove at its afore mentioned side seam with their respective through bores being aligned in use. Of course, a single loop of a greater axil length might be substituted for this loop pair, the significant function being that the loop means receives a conventional golf tee, and snugly, yet yieldingly, holds and orients it the position and attitude described.

It will be understood that while a preferred embodiment of the present invention is presented herein, numerous of the individual elements and functional aspects described may be modified somewhat within the spirit and scope of the invention, which therefore should not be limited to the details of this precise disclosure, but, rather, should be awarded the full range implicit in the described invention. Wherefore, it will be understood that the structural elements of the glove disclosed necessarily in describing this embodiment can be replaced by other means which are obvious while still conforming to this invention.

Unless defined otherwise, all technical and scientific terms used herein have the same meaning as commonly understood by one of ordinary skill in the art to which this invention belongs. Any methods and materials similar or equivalent to those described can be used in the practice of the present invention; and, accordingly, all equivalent structure disclosed in various publications and patents of equivalent elements of this invention are incorporated herein whether by direct reference or not.

While the principles of the invention have been made clear in an illustrative embodiment, there will be immediately obvious to those skilled in the art that there are many modifications of structure, arrangements, proportions, the elements, materials, and components used in the practice of the invention, and otherwise are particularly adapted to specific environments and operative requirements without departing to those principles.

What is claimed is:

1. A golf glove comprising an inner and an outer surface, and a first portion to confront the palm of a wearer, a second portion to confront the back of the hand of a wearer, a thumb side portions, and a little finger side portion, said glove being sized to snugly fit the hand of a golfer, said little finger side portion including a length sized to overlay the outboard side surface of the hand of the golfer between the wrist bone carpals and the little finger phalange and along the metacarpals, a golf tee storage means on the length defining a golf tee socket means to snugly and circumferentially hold a golf tee without interferring with the wrist action of the wearer while golfing.

2. The glove as set forth in claim 1 wherein said said socket means comprises a first and a second spaced loop of elastic material on said length, said loops having a common axis parallel to said length.

3. The glove as set forth in claim 1 wherein the glove is of a pliable and stretchable material.

* * * * *